US009554423B2

(12) United States Patent
Paull

(10) Patent No.: US 9,554,423 B2
(45) Date of Patent: Jan. 24, 2017

(54) INDUCTION HEATING SYSTEM

(71) Applicant: Ameritherm, Inc., Scottsville, NY (US)

(72) Inventor: Ian A. Paull, Henrietta, NY (US)

(73) Assignee: Ambrell Corporation, Scottsville, NY (US)

( * ) Notice: Subject to any disclaimer, the term of this patent is extended or adjusted under 35 U.S.C. 154(b) by 571 days.

(21) Appl. No.: 14/063,359

(22) Filed: Oct. 25, 2013

(65) Prior Publication Data

US 2014/0151367 A1 Jun. 5, 2014

Related U.S. Application Data

(60) Provisional application No. 61/718,528, filed on Oct. 25, 2012.

(51) Int. Cl.
*H05B 6/08* (2006.01)
*H05B 6/06* (2006.01)

(52) U.S. Cl.
CPC ..... *H05B 6/06* (2013.01)

(58) Field of Classification Search
CPC ..... H05B 6/06; H05B 6/062; H05B 6/1209
USPC ..... 219/666, 663, 665, 667, 661, 670, 650, 219/779, 645; 363/95, 97, 17, 49, 71, 79, 363/37, 96; 323/234, 265, 285, 293, 227; 327/581
See application file for complete search history.

(56) References Cited

U.S. PATENT DOCUMENTS 3,566,243 A * 2/1971 Landis ..... H02M 5/44 363/37
4,356,371 A * 10/1982 Kiuchi ..... H05B 6/062 219/626
2013/0277362 A1* 10/2013 Ribarich ..... H05B 6/1209 219/620

* cited by examiner

*Primary Examiner* — Quang Van
(74) *Attorney, Agent, or Firm* — Rothwell, Figg, Ernst & Manbeck. P.C.

(57) ABSTRACT

A tuning system for controlling a voltage controlled oscillator is described herein. The tuning system makes use of a dual edge phase detector.

7 Claims, 7 Drawing Sheets

V & I ALIGNED AT RESONANCE

INDUCTION HEATING SYSTEM

CROSS-REFERENCE TO RELATED APPLICATIONS

This application claims the benefit of U.S. Provisional Patent Application No. 61/718,528 filed on Oct. 25, 2012, which application is incorporated by reference herein in its entirety.

TECHNICAL FIELD

This disclosure relates to tuning methods (e.g., tuning methods that may be used in an inducting heating system).

BACKGROUND

Induction heating generally refers to the process of heating an object (usually a metal object) by exposing the object to a time-varying magnetic field and, thereby, inducing a current (e.g., an eddy current) in the object. The induced current creates heat. To create the time-varying magnetic field, an induction heating system may be used. An induction heating system typically includes: (1) a voltage controlled oscillator (VCO) for producing a time varying signal (e.g., a radio frequency (RF) signal) and (2) a tank circuit (a.k.a., "load") comprising a coil coupled to the VCO (the coil may be coupled to the VCO by a drive circuit). The coil produces the time-varying magnetic field based on the output of the VCO. In many applications, it is desirable that the frequency of the time varying signal match the resonant frequency of the tank circuit.

Digital phase detectors have been used for many years in phase locked loops to control the output of a VCO. Generally, the intent is to sense the phase and/or frequency of the VCO output and compare this in some fashion to a reference, and then to adjust the VCO as a result. The goal may be to make a fixed phase relationship between the VCO and the reference, or to make a fixed frequency relationship between the VCO and the reference.

Digital phase detectors may be sensitive to input level (high or low) or to input signal edges (rising or falling) for their operation. Those that are edge sensitive have been known to compare edges at either the beginning of a cycle or the end of a cycle. Control loop adjustment of a VCO as a result will then align the sensed edges as the desired target condition.

In some applications, one of the signals to be compared may be of variable duty cycle. This could be so that an amplitude can be controlled. Further, there are applications where resonance of a load circuit must be determined and tracked where one of the sensed signals has a variable duty cycle and the other may not be. For a parallel resonant load, for example, a power bridge drive circuit may have a variable duty cycle current into the load and the voltage across the load may be nearly a sine wave (see FIG. 1). At the point of phase resonance, the timing of the current pulse will be in phase with the voltage such that the current is equally spaced in time from the zero crossings of the voltage waveform, as shown in FIG. 1 (in all graphs shown, time is increasing along the horizontal axis). When a conventional phase detector is used, the zero crossing of the voltage waveform will be aligned with only one side of the current waveform. Changes to the current duty cycle then cause a variation in phase between the waveforms, resulting in a frequency error.

There is a need therefore to overcome this disadvantage of conventional digital phase detectors.

SUMMARY

A tuning system for controlling a voltage controlled oscillator is described herein. The tuning system makes use of a dual edge phase detector.

BRIEF DESCRIPTION OF THE DRAWINGS

The accompanying drawings, which are incorporated herein and form part of the specification, illustrate various embodiments.

DETAILED DESCRIPTION

Figure 1:
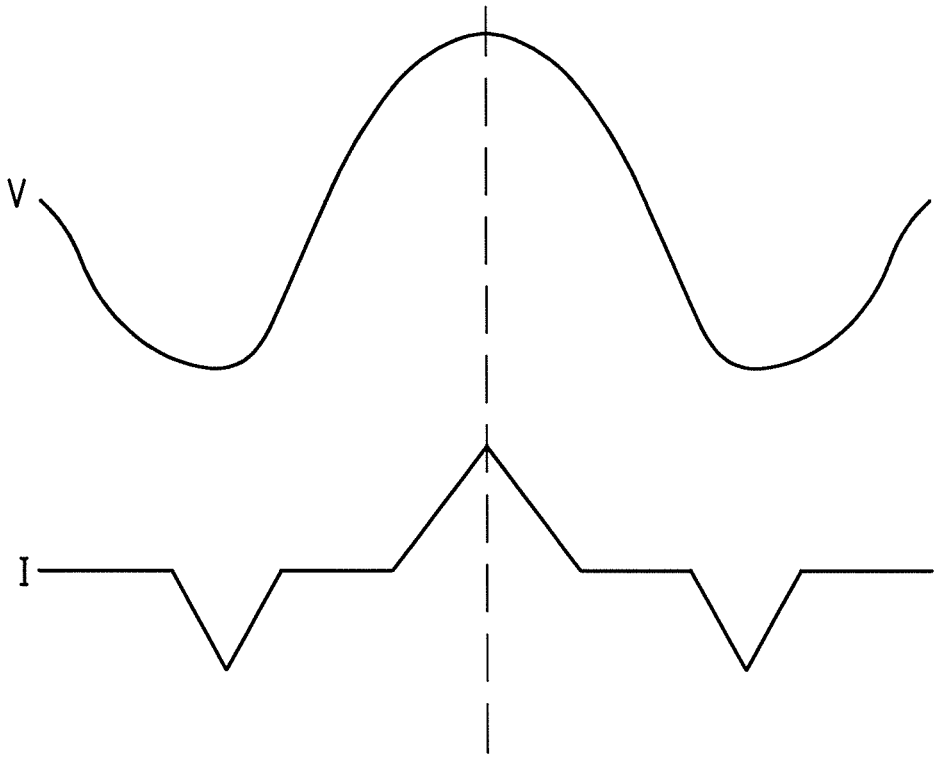
FIG. 1 is a graph showing a voltage signal and a current signal.
Figure 2:
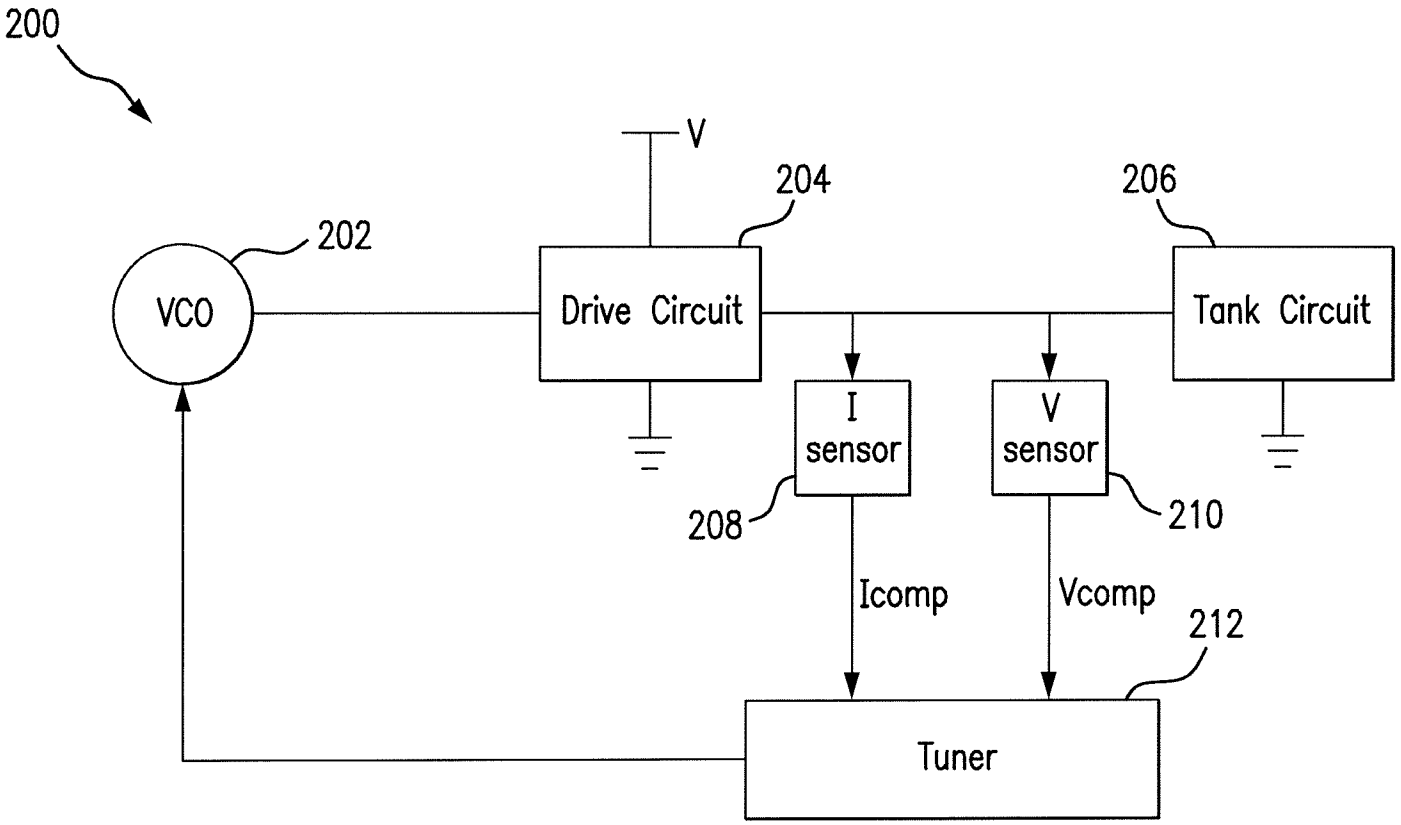
FIG. 2 illustrates a system according to some embodiments.

FIG. 2 illustrates an induction heating system 200 according to some embodiments. As shown in FIG. 2, in some embodiments, system 200 includes a VCO 202, a tank circuit 206 coupled to the VCO by a drive circuit 204, a current sensor 208 that produces signal Icomp, a voltage sensor 210 that produces signal Vcomp, and a tuner 212 for controlling the output of VCO 202 based on Icomp and Vcomp.

Figure 3:
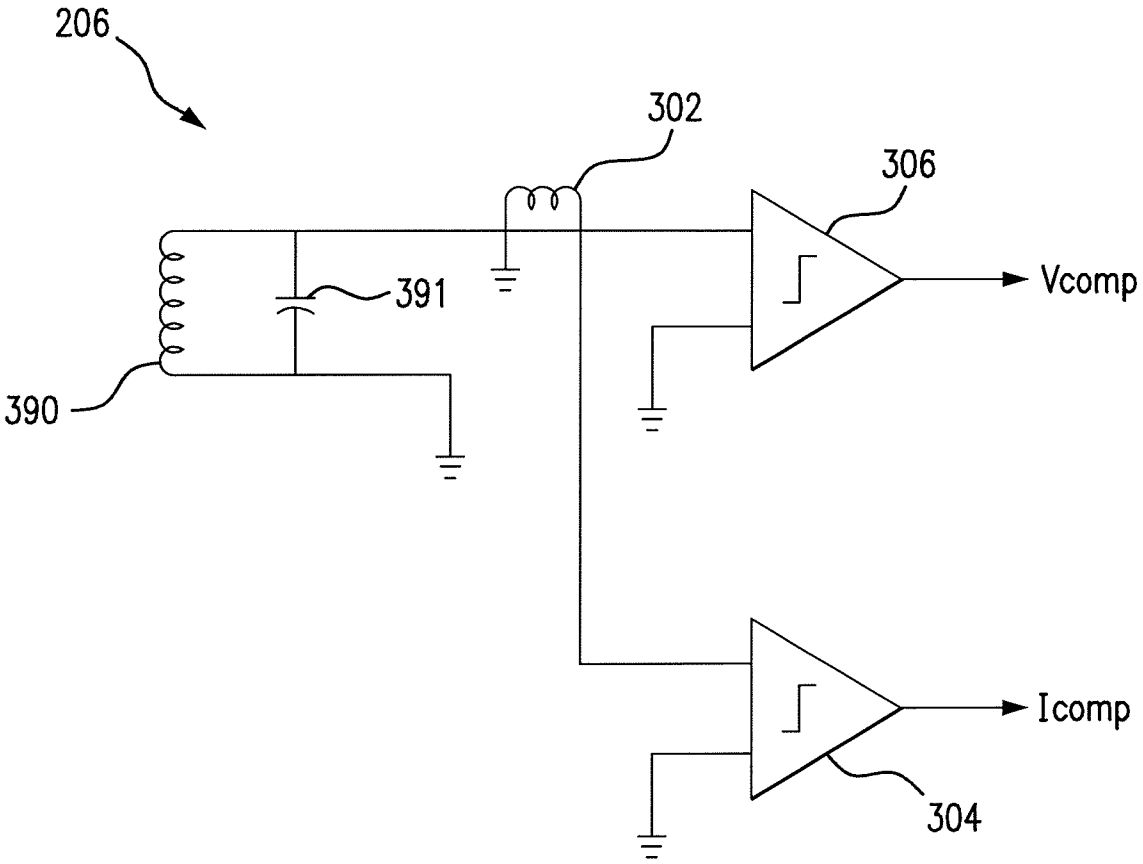
FIG. 3 illustrates a voltage sensor and a current sensor according to some embodiments.
Figure 5:
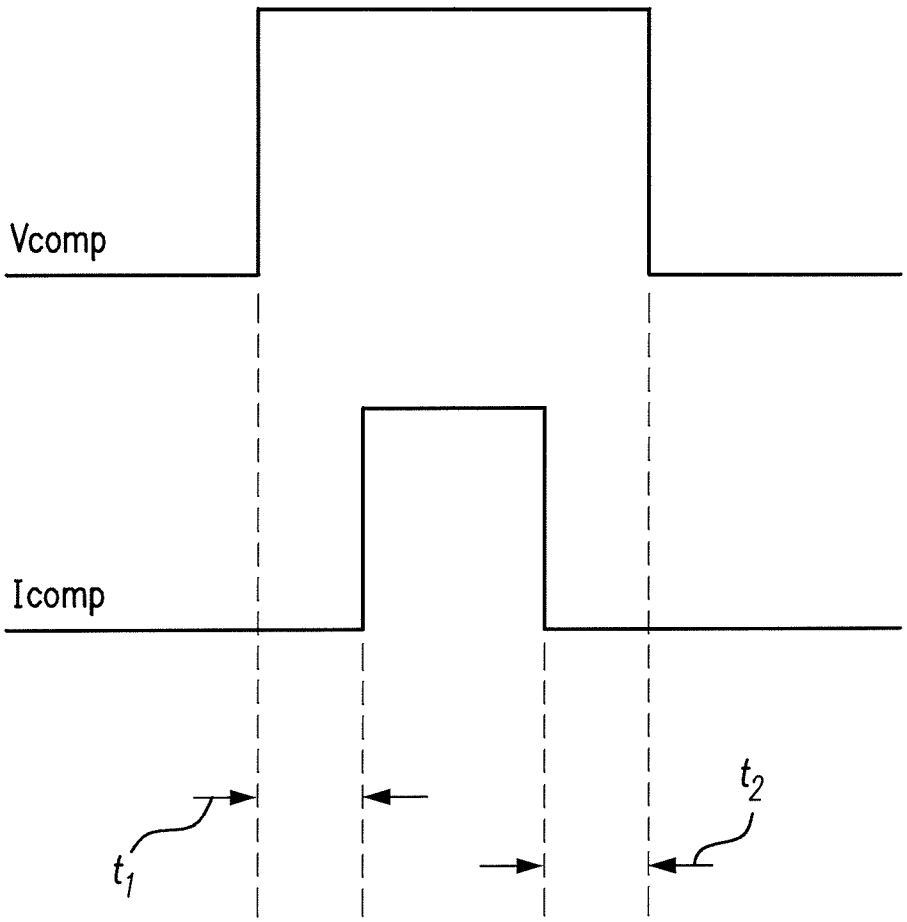
FIG. 5 illustrates a portion of two control signals.

FIG. 3 illustrates an example tank circuit 206, an example current sensor 208 and an example voltage sensor 210. In the embodiment shown, tank circuit 206 includes an inductor 390 and a capacitor 391 connected in parallel with the inductor 390; current sensor 208 includes an inductor 302 and a comparator 304; and voltage sensor 210 includes a comparator 306. Although a parallel resonant circuit is shown, a series resonant circuit may also be used with appropriate feedback sense. Current and voltage samples from parallel resonant circuit 206 are digitized by the use of comparators 304 and 306, as in FIG. 3. The resulting waveforms are shown in FIG. 5. The timing shown is at resonance, indicated by $t1=t2$.

Figure 4:
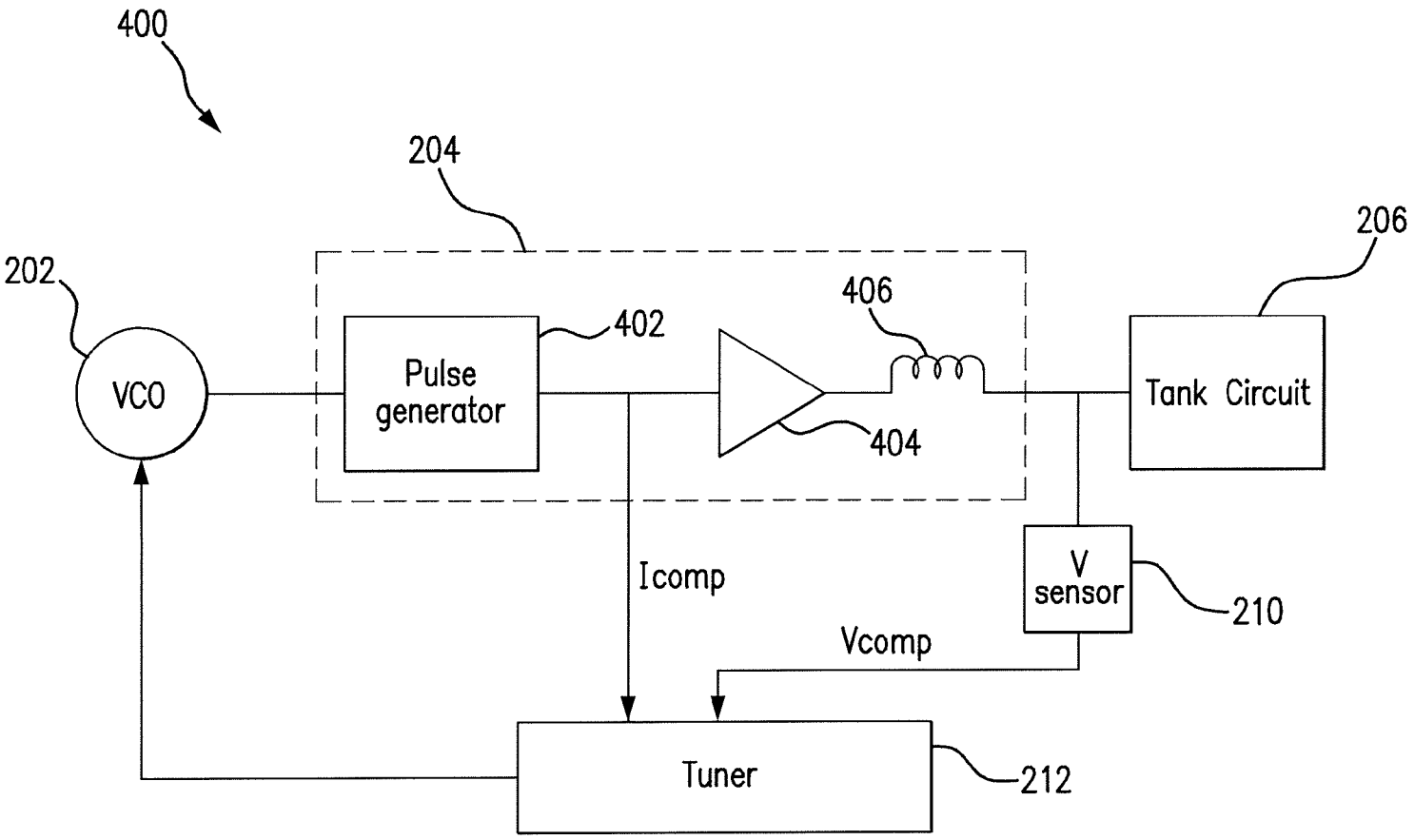
FIG. 4 illustrates a system according to another embodiment.

FIG. 4 illustrates heating system 400 according to another embodiment. In this this embodiment, the Icomp signal is produced by the drive circuit 204. More specifically, the Icomp signal is produced by a pulse generator 402, which is a component of drive circuit 204. As shown, the output of pulse generator 402 is also fed into a power stage 404, which may comprise IGBT/MOSFET driver integrated circuits (ICs) and an IGBT/Mosfet bridge, as is known in the art. Additionally, an inductor 406 may be positioned between the power stage 404 and tank circuit 206. The relationship between Vcomp and Icomp shown in FIG. 4 holds essentially true for the embodiment shown in FIG. 5. That is, in the embodiment shown in FIG. 4, there is a slight phase shift between Icomp and Vcomp at resonance such that at resonance $t1$ is not equal to $t2$, rather $|t1-t2|=c$, where $c>0$.

Figure 6:
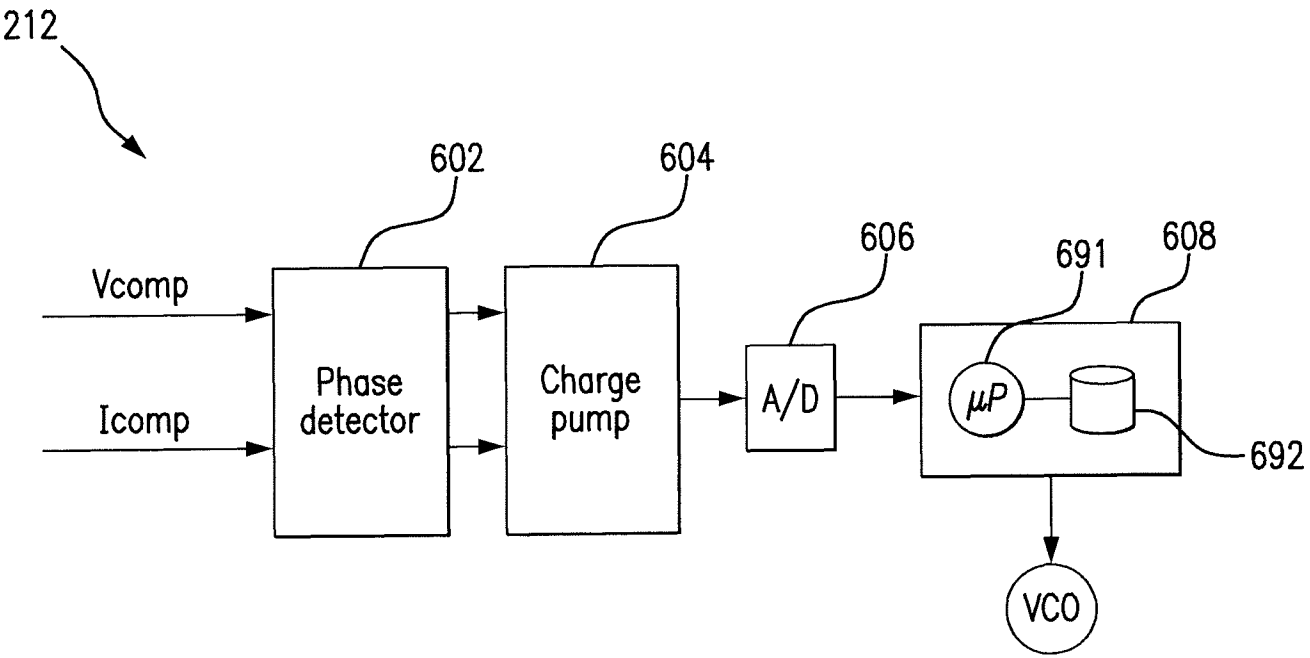
FIG. 6 illustrates a tuner according to some embodiments.

Turning now to FIG. 6, FIG. 6 illustrates tuner 212 according to some embodiments. In the example shown, tuner 212 includes a phase detector 602 that controls a charge pump 604 that charges and discharges an energy storage device (ESD). In some embodiments, the voltage value of the ESD is digitized by an A/D converter 606 and this digital output is processed by a data processing system 608, which may include a processor 691 (e.g., a microprocessor) and a data storage unit 692 (e.g. a non-transitory computer readable medium) that stores data and software that is executed by microprocessor 691.

A control signal output by the data processing system 608 controls the frequency of the signal output by the VCO, which may be a direct digital synthesizer (DDS). The control signal output by the processing circuit is based on the voltage of the ESD. For example, the control signal is a function of the voltage of the ESD and one or more threshold values stored in data storage unit 692. The magnitude of a particular threshold value may be different depending on whether system 200 or system 400 is being used. For example, when system 200 is being used, a threshold value maybe 2.5 volts, and when system 300 is being used a threshold value may be 3.0 volts. This difference in threshold values compensates for the fact that, in the embodiment shown in FIG. 4, when the frequency of the signal produced by the VCO 202 is equal to the resonant frequency of the tank circuit, $|t1-t2|=c$.

As a specific example, tuner 212 will modify (increase or decrease) the frequency of the signal output by the VCO 202 when output voltage of the charge pump (e.g., the voltage across the ESD) is greater than or less than a threshold. In this way, the tuner 212 can control the frequency of the signal produced by the VCO 202. That is, for example, the processor 691 compares the value output by A/D converter 606 with a threshold value stored in data storage 692 and, based on the comparison, makes a decision as to whether to adjust the frequency of the signal output by the VCO 202. For example, if the value output by A/D converter 606 is greater than a threshold value, then processor 691 may be configured to cause the VCO to output a signal with a lower frequency. Similarly, if the value output by A/D converter 606 is less than a threshold value, then processor 691 may be configured to cause the VCO to output a signal with a higher frequency.

Figure 7:
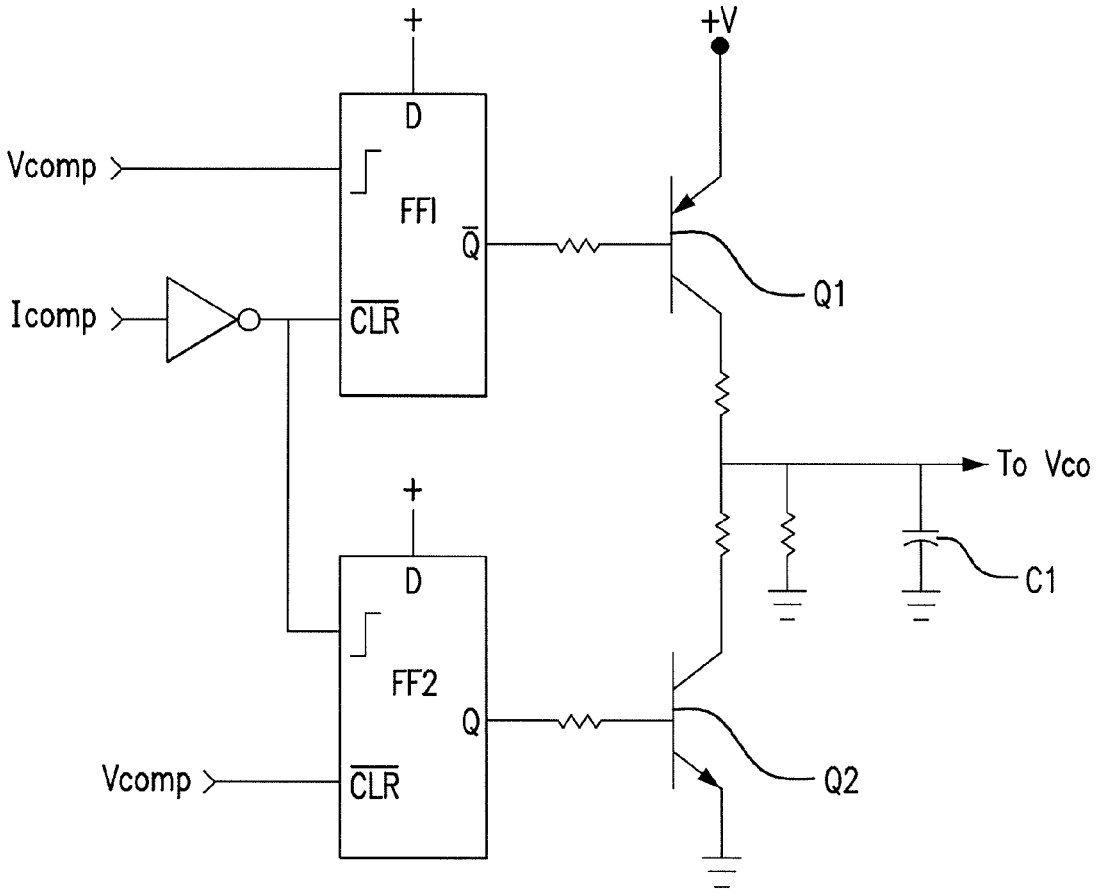
FIG. 7 illustrates a phase detector and a charge pump according to some embodiments.

FIG. 7 illustrates phase detector 602 and charge pump 604 according to some embodiments. In the example shown in FIG. 5, phase detector 602 includes: a first flip flop (FF1), a second flip flop (FF2) (FF1 and FF2 may be type D flip flops, as shown), and an inverter (a.k.a., "NOT gate"), the output of which is connected to a clr input of FF1; and charge pump 604 includes a first switching device Q1 (e.g., a first transistor); a second switching device Q2 (e.g., a second transistor); and the energy storage device in the form of capacitor C1. The outputs of flip flops FF1 and FF2 control charge pump 604 to convert timing errors to a correction voltage (i.e., the voltage across C1), which may be processed by processing circuit 608 and then sent to control the VCO.

Operation of the phase detector 602 begins with the rising edge of Vcomp, where the positive voltage on the D input of FF1 is latched by the driven clock input. This causes the Q NOT output of FF1 to go low, turning on the positive charge pump Q1 and increasing the charge in C1. This charge increases until the rising edge of Icomp, which clears FF1 and sends Q NOT high and turns off the positive charge pump Q1. The duration of charge increase in C1 is proportional to time interval t1. The falling edge of Icomp clocks the positive D input onto FF2, causing the Q output of FF2 to go high, turning on negative charge pump Q2, removing charge from C1. This removal continues until the falling edge of Vcomp which turns off Q2. The duration of charge removal on C1 is therefore proportional to t2.

Accordingly, when t1=t2, charge increase and charge decrease in C1 are equal, and there is no net change in charge or output voltage (i.e., the average charge remains constant). Likewise, when t1 !=t2, the output voltage (i.e. the voltage across C1) will increase or decrease. Because the control signal that controls the VCO is based on the output voltage, the VCO can be controlled by the tuner 212 such that the average output voltage is at some desired value (e.g., 2.5 volts or 3.0 volts depending on the source of the Icomp signal).

While various embodiments have been described above, it should be understood that they have been presented by way of example only, and not limitation. Thus, the breadth and scope of the present disclosure should not be limited by any of the above-described exemplary embodiments. Moreover, any combination of the above-described elements in all possible variations thereof is encompassed by the disclosure unless otherwise indicated herein or otherwise clearly contradicted by context.

Additionally, while the processes described above and illustrated in the drawings are shown as a sequence of steps, this was done solely for the sake of illustration. Accordingly, it is contemplated that some steps may be added, some steps may be omitted, the order of the steps may be re-arranged, and some steps may be performed in parallel.

The invention claimed is:

1. An induction heating system, comprising:

a tank circuit;

a drive circuit coupled to the tank circuit for driving the tank circuit, the drive circuit outputting a voltage and a current;

a tuner comprising an energy storage device (ESD), an analog to digital (A/D) converter for producing a digital value corresponding to a voltage of the ESD, a processor and a data storage unit storing a threshold value;

a voltage controlled oscillator (VCO) for providing to the drive circuit a signal having a frequency, the frequency of the signal being dependent on a control signal output by the processor; wherein the induction heating system is configured to produce i) a first pulse signal based on a voltage applied to the tank circuit, wherein the first pulse signal comprise a plurality of "voltage" pulses, and ii) a second pulse signal comprising a plurality of "current" pulses and each of said plurality of current pulses being associated with one of the plurality of voltage pulses, the tuner is configured such that, for each of said plurality of voltage pulses, i) a current flows to the ESD for a first period of time proportional to X and ii) a current flows out of the ESD for a second period of time proportional to Y, X is the amount of time between a rising edge of the voltage pulse and a rising edge of the current pulse associated with the voltage pulse, Y is the amount of time between a falling edge of the current pulse associated with the voltage pulse and a falling edge of the voltage pulse, and the control signal output by the processor is dependent upon the digital value produced by the A/D converter and the threshold value.

2. The induction heating system of claim 1, further comprising:

a voltage sensor for producing the first pulse signal based on the voltage output by the drive circuit.

3. The induction heating system of claim 2, wherein the voltage sensor comprises a first comparator for comparing a voltage applied to the tank circuit to a reference.

4. The induction heating system of claim 3, further comprising:

a current sensor for producing the second pulse signal based on a current output by the drive circuit.

5. The induction heating system of claim 4, wherein the current sensor comprises a second comparator for comparing a signal representing a current applied to the tank circuit to a reference.

6. The induction heating system of claim 1, wherein the tuner further comprises a phase detector and a charge pump comprising the ESD, a first switching device, and a second switching device.

7. The induction heating system of claim 6, wherein the phase detector includes a first flip flop and a second flip flop, an output of the first flip flop controls the first switching device, and an output of the second flip flop controls the second switching device.

* * * * *